US006676355B1

(12) United States Patent
Peyton

(10) Patent No.: US 6,676,355 B1
(45) Date of Patent: Jan. 13, 2004

(54) APPARATUS AND METHOD TO EFFECTUATE PRE-LIFT POSITIONING FOR A DROP FURNACE CAGE

(75) Inventor: Raleigh F. Peyton, Sapulpa, OK (US)

(73) Assignee: American Airlines, Inc., Dallas, TX (US)

( * ) Notice: Subject to any disclaimer, the term of this patent is extended or adjusted under 35 U.S.C. 154(b) by 204 days.

(21) Appl. No.: 09/910,239

(22) Filed: Jul. 20, 2001

(51) Int. Cl.[7] ..... B66C 17/08
(52) U.S. Cl. ..... 414/152; 414/154; 414/172
(58) Field of Search ..... 414/150, 152, 414/154, 172, 222.04, 222.05, 331.06, 331.11, 396, 401; 432/121, 261, 239, 253

(56) References Cited

U.S. PATENT DOCUMENTS 1,413,867 A * 4/1922 Mueller ..... 99/427
3,262,420 A * 7/1966 Bossi et al. ..... 118/57
3,603,269 A * 9/1971 Royer ..... 414/152
3,603,271 A * 9/1971 Remensperger et al. .... 414/152
4,697,974 A * 10/1987 Eltoukhy ..... 414/331.09
5,224,812 A * 7/1993 Oslin et al. ..... 414/401
5,441,376 A * 8/1995 Napierkowski et al. ..... 414/401
5,641,260 A * 6/1997 Gray ..... 414/401
6,036,424 A * 3/2000 Santangelo et al. ..... 414/152
6,205,881 B1 * 3/2001 Gravell et al. ..... 74/483 R
6,231,292 B1 * 5/2001 Wyssmuller et al. ... 414/331.07
6,494,671 B1 * 12/2002 Takaiti et al. ..... 414/809

FOREIGN PATENT DOCUMENTS

WO WO 97/12506 * 4/1997

* cited by examiner

*Primary Examiner*—James W. Keenan
(74) *Attorney, Agent, or Firm*—Head, Johnson and Kachigian

(57) ABSTRACT

An apparatus and method whereby precise furnace cage positioning may be effectuated. The apparatus of the instant invention is embodied as a uniquely structured multi-plane positioning device which comprises the positional attachment of a drop furnace cage to a drop furnace quench tank via a combination of connecting structures attached to one or more positioning bars which limit the furnace cage's forward, backward and lateral movement as well as a pair of drop cage retrieval hooks directed for attachment to retrieval bars located between pairs of retrieving structures to accurately position the drop furnace cage for vertical retrieval into the furnace.

9 Claims, 4 Drawing Sheets

APPARATUS AND METHOD TO EFFECTUATE PRE-LIFT POSITIONING FOR A DROP FURNACE CAGE

REFERENCE TO PENDING APPLICATIONS

This application is not related to any pending applications.

REFERENCE TO MICROFICHE APPENDIX

This application is not referenced in any microfiche appendix.

TECHNICAL FIELD OF THE INVENTION

In general, the present invention is directed to drop furnaces and cages used in association therewith. In particular, the present invention is directed towards an apparatus and method whereby precise pre-lift positioning of a drop furnace cage may be effectuated, prior to retrieval of said cage into the interior portions of a drop furnace.

BACKGROUND OF THE INVENTION

Drop furnaces are widely known and utilized to address heat treatment requirements associated with metals, ceramics and other materials. Quite typically, such processes are associated with the manufacturer of metal components or parts which require heat treatment prior to production use. An example would be the manufacture of uniquely designed aircraft parts. Such parts are typically "formed" during a metal's normally "pliable" state. Once formed however, heat treatment of the part would be required, prior to its production use in/on an aircraft. Said heat treatment of sufficient duration and temperature to ensure component strength, tempering and operational resistance to stress.

Parts to be heat treated are generally positioned within a drop furnace component known as a drop furnace cage. In operation, the interior portion of a drop furnace is typically pre-heated to a temperature consistent with that required to effectuate proper "heat treatment" of articles placed within the drop furnace cage. The cage is then retrieved or otherwise drawn into the internal portion of the drop furnace and therein secured for a period of time necessary to effectuate adequate heat treatment. Upon completion of the heat treatment cycle, the drop furnace typically employs a second component known as a quench tank. The quench tank typically traverses a track surface and is positioned directly under the internal heat treating portion of the drop furnace. The cage, still containing the heat treated articles, is then lowered into the quench tank for a specified period of time to complete the heat treatment cycle.

In manufacturing applications it is quite possible for the heat treatment of articles to occur over a 24 hour basis, with retrieval of articles into the drop furnace occurring 20 or more times per day. Consequently, it is essential that prior to retrieving the drop furnace cage, the cage be positioned accurately to avoid causing misalignment damage to the internal portion of the furnace. Failure to do so provides potential to cause severe damage to the internal portions of the drop furnace. Hence, given the deficiencies of the present art and improvements afforded by the instant invention what is needed is an improved method and apparatus whereby a drop furnace cage may be accurately positioned prior to retrieval into the internal portions of the drop heating furnace.

BRIEF SUMMARY OF THE INVENTION

The present invention provides for an improved method and apparatus for greatly improving upon the prior art. The instant invention discloses and claims an apparatus and method whereby precise furnace cage positioning may be effectuated. The apparatus of the instant invention is embodied as a uniquely structured positioning device which comprises one or more connecting structures attached to one or more positioning bars, said positioning bars further embodying appendages designed to be accommodated within, or make contact with, complimenting receptacles attached to a drop furnace cage. By so aligning said positioning bar appendages, precise positioning of the drop furnace cage can be effectuated to allow timely retrieval of the cage into the interior portion of the drop furnace while minimizing misalignment damage potential.

Consequently it is an objective of the instant invention to minimize the potential for damage to the internal portion of a drop furnace when retrieving a drop furnace cage into said internal portion.

It is a further object of the instant invention to provide an apparatus and method whereby a drop furnace cage may be precisely positioned in repeatedly and timely manner prior to retrieving said cage into the internal portion of a drop furnace.

An additional objective of the instant invention is to provide flexibility in the structuring of the invention's positioning apparatus whereby said apparatus may be generally attached to a drop furnace quench tank or drop furnace cage.

Other objects and further scope of the applicability of the present invention will become apparent from the detailed description to follow, taken in conjunction with the accompanying drawings wherein like parts are designated by like reference numerals.

BRIEF DESCRIPTION OF THE DRAWINGS

Prior art

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is intended.

While the invention has been described with a certain degree of particularity, it is clear that many changes may be made in the details of construction and the arrangement of components without departing from the spirit and scope of this disclosure. It is to be understood that the invention is not limited to the embodiments set forth herein for purposes of exemplification, but is to be limited only by the scope of the attached claim or claims, including the full range of equivalency to which each element thereof is entitled.

Figure 1:
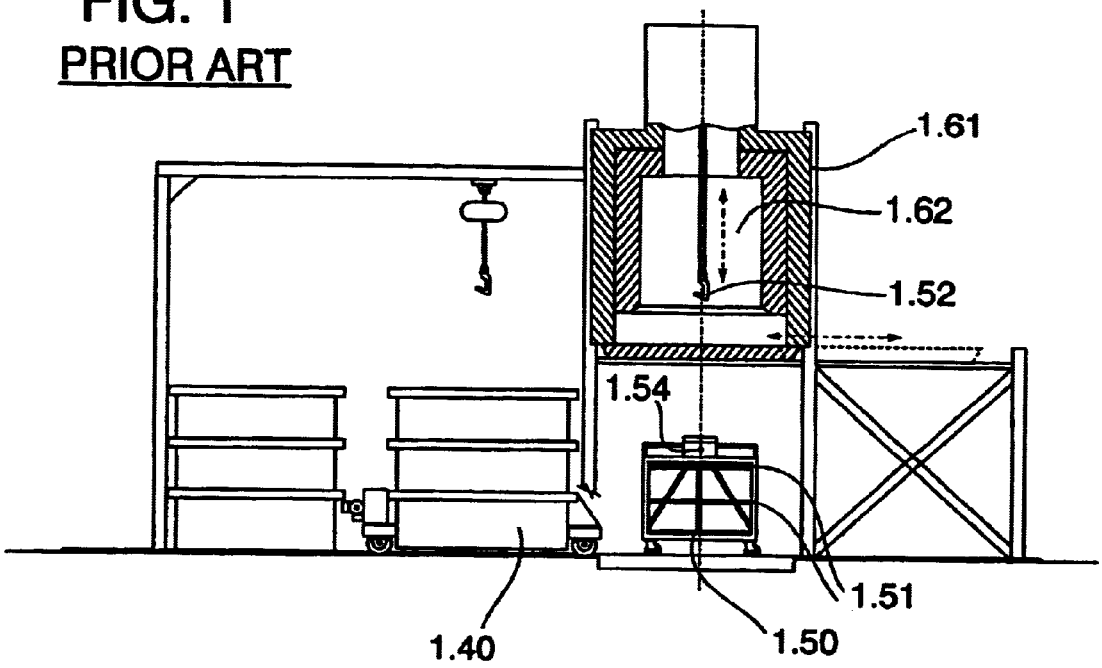
FIG. 1 PRIOR ART
FIG. 1 is a representative illustration of a prior art drop furnace.
Figure 2:
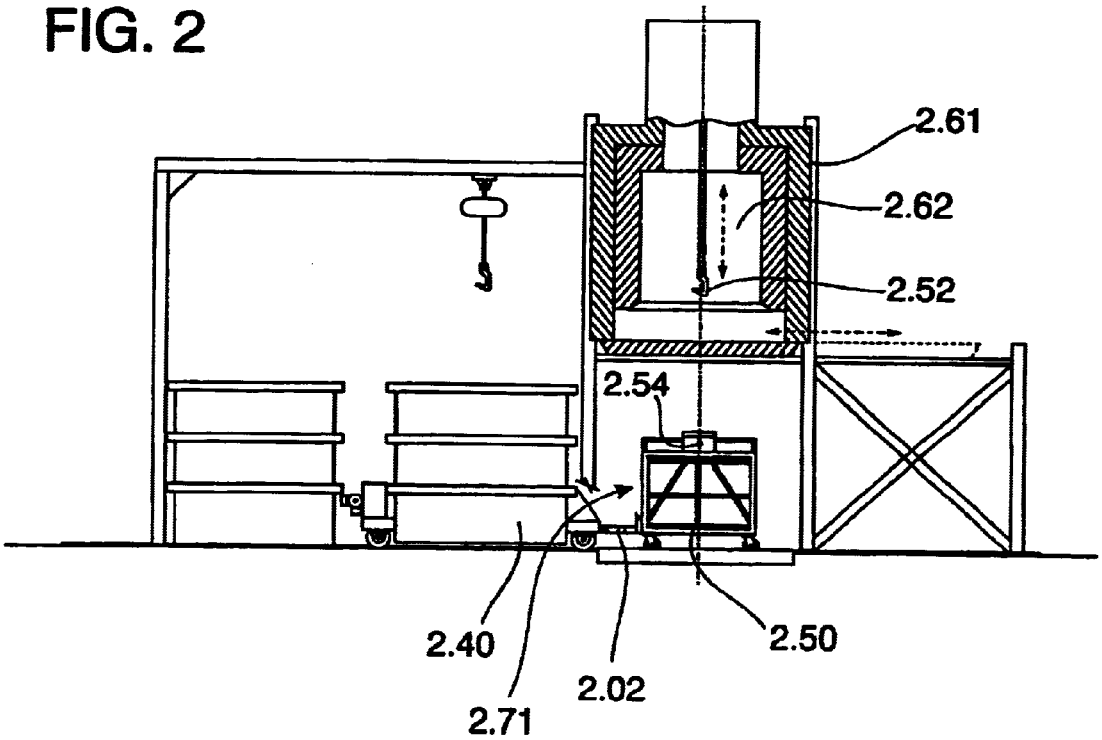
FIG. 2 is an illustration of a drop furnace as practiced in association with the instant invention.

FIG. 1 illustrates a drop furnace as represented in the prior art. In FIG. 1 a drop furnace cage 1.50 is shown generally positioned under a drop furnace 1.61. Articles to be heat treated are typically placed on racks 1.51 of the drop cage, and utilizing a drop furnace retrieval hook 1.52, the drop cage 1.50 is retrieved (a.k.a. lifted) into the internal portions of the drop cage 1.62. To effectuate said retrieval, the retrieval hook 1.52 is lowered to meet a drop cage retrieval structure 1.54 such as but not limited to a bar which typically traverses on a horizontal plane the entire upper surface of the drop cage 1.50. A potential for damage to the internal portion of the drop cage 1.62 exists whenever the retrieval hook 1.52 is improperly positioned or otherwise makes mis-aligned contact with the retrieval structure 1.54. FIG. 2 illustrates a drop furnace as practiced in association with the instant invention. Turning now to FIG. 2.

Figure 3A:
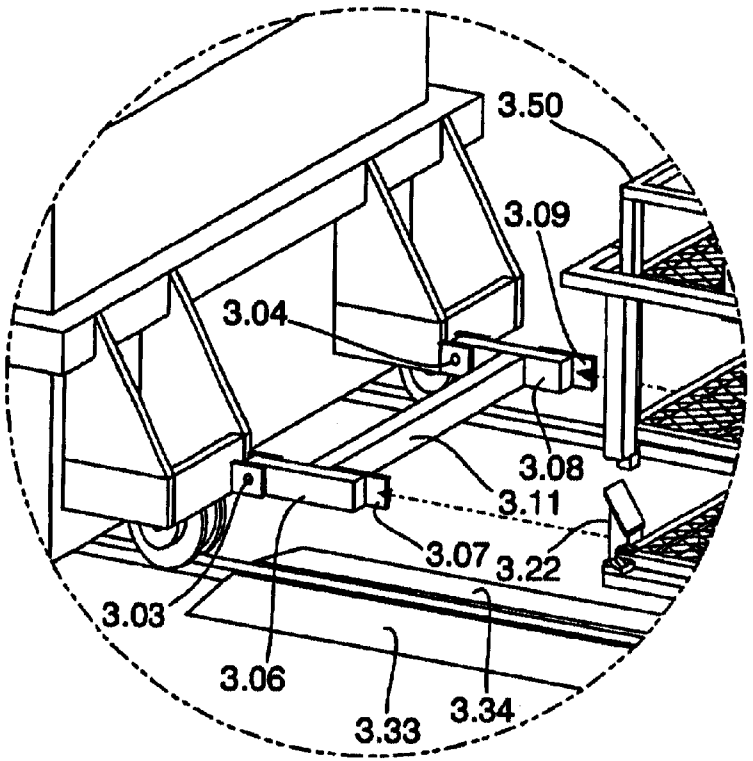
FIGS. 3 and 3A illustrate further detail with respect to the invention's apparatus when practiced in its preferred embodiment.
Figure 3:
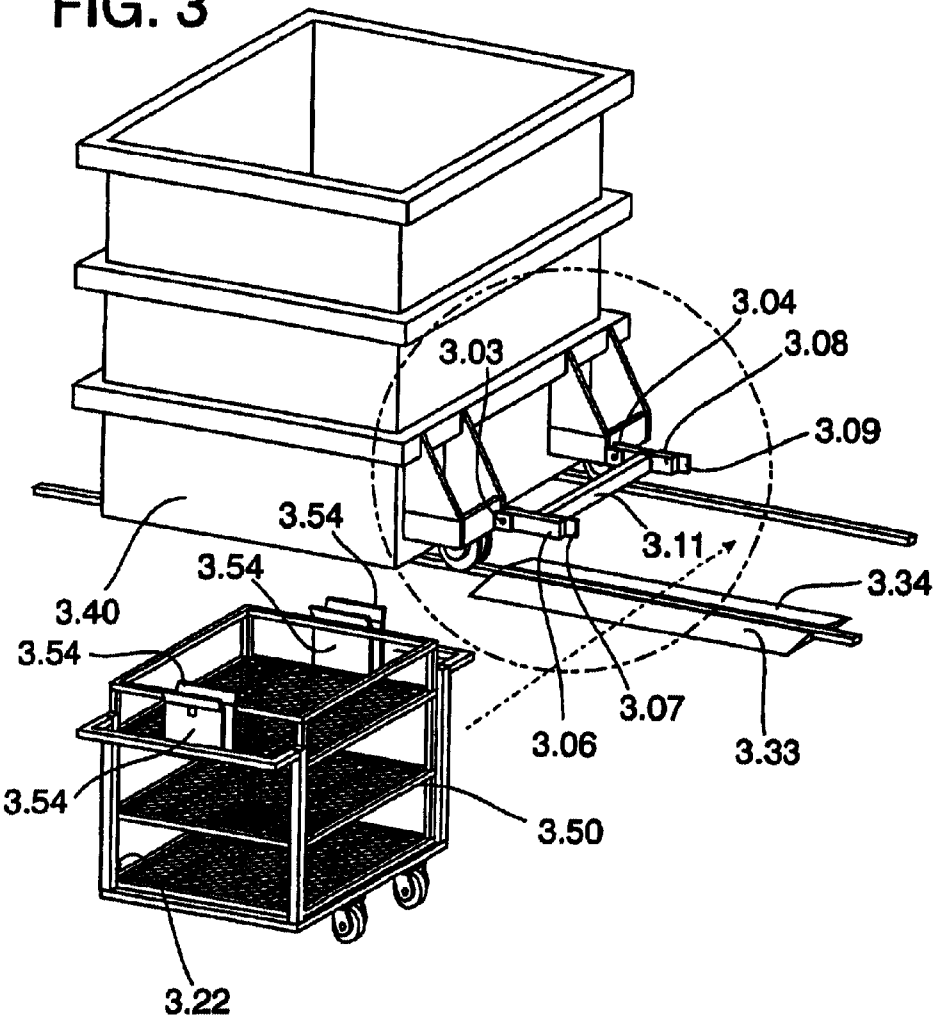

In FIG. 2 the general location of the instant invention is shown as elements 2.02 and 2.54. Via utilization of the instant invention, which may be used to attach a drop cage 2.50 to a drop cage quench tank 2.40 on a first side 2.71 and a pair of drop cage retrieval hooks 2.52 (one shown in FIG. 2. side view) connected to retrieval bars positionally inserted between pairs of retrieval structures 2.54 (disclosed in detail as 3.54 in FIG. 3), the drop cage 2.50 may be precisely positioned centrally under the internal portion 2.62 of a drop furnace 2.61. FIG. 3 provides greater detail with respect to the structure of the invention as practiced in its preferred embodiment. Turning now to FIG. 3.

Figure 4:
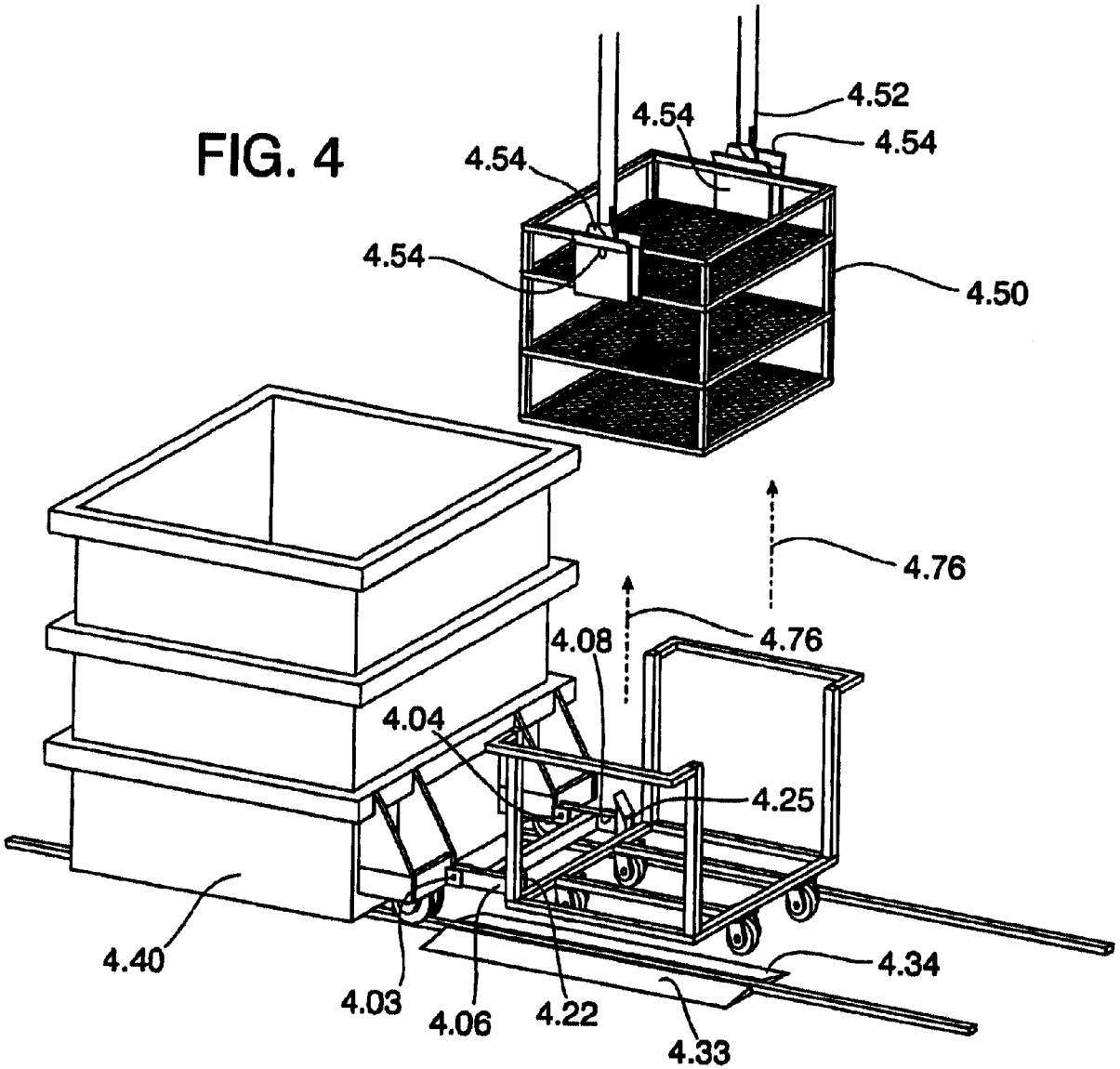
FIG. 4 is an illustration of the invention as practiced in its preferred embodiment further detailing retrieval of a drop furnace cage having once positioned said cage utilizing the apparatus of the instant invention.

As can be seen in FIG. 3, a first connecting structure 3.03 is attached to a fixed position drop furnace component. "Fixed position" as used herein refers to a known location drop furnace component such as but not limited to a location on a drop furnace quench tank 3.40 or drop furnace cage 3.50. In extensive testing it has been shown that most efficient and timely practice of the instant invention can be effectuated using a single or plurality of connecting structures attached to a drop furnace quench tank 3.40. Attached to the first connecting structure 3.03 is a first positioning bar 3.06 which is aligned to permit insertion of an attached appendage 3.07 into a first positioning bar receptacle 3.22. Though possible to effectuate practice of the instant invention with a single connecting structure positioning bar, positioning bar appendage and positioning bar receptacle, extensive testing of the instant invention has shown that such practice is best accommodated when further utilizing at least a second connecting structure 3.04 attached to a second positioning bar 3.08 and second positioning bar appendage 3.09. As seen in FIGS. 3 and 3A, an interconnecting support member 3.11 is attached to and between said first 3.06 and second 3.08 positioning bars. Also seen in FIGS. 3 and 3A and used in association with practice of the instant invention are the instant invention's beveled track inclines 3.33 and 3.34. Said inclines 3.33 and 3.34 are purposed to allow the timely alignment and positioning of the positioning bar receptacles 3.22 and positioning bar appendages 3.07 and 3.09. FIG. 4 further illustrates the invention as practiced in its preferred embodiment further detailing retrieval of the drop furnace cage having once positioned said cage utilizing the apparatus of the instant invention. Turning now to FIG. 4.

Figure 5:
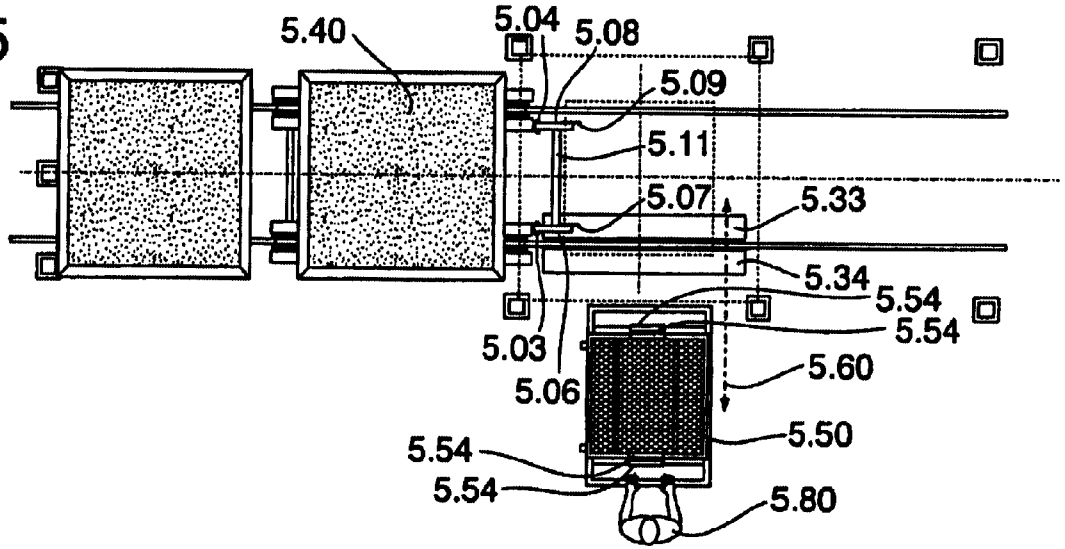
FIGS. 5 and 6 provide top view illustrations of positioning a drop furnace cage utilizing the apparatus of the instant invention.
Figure 6:
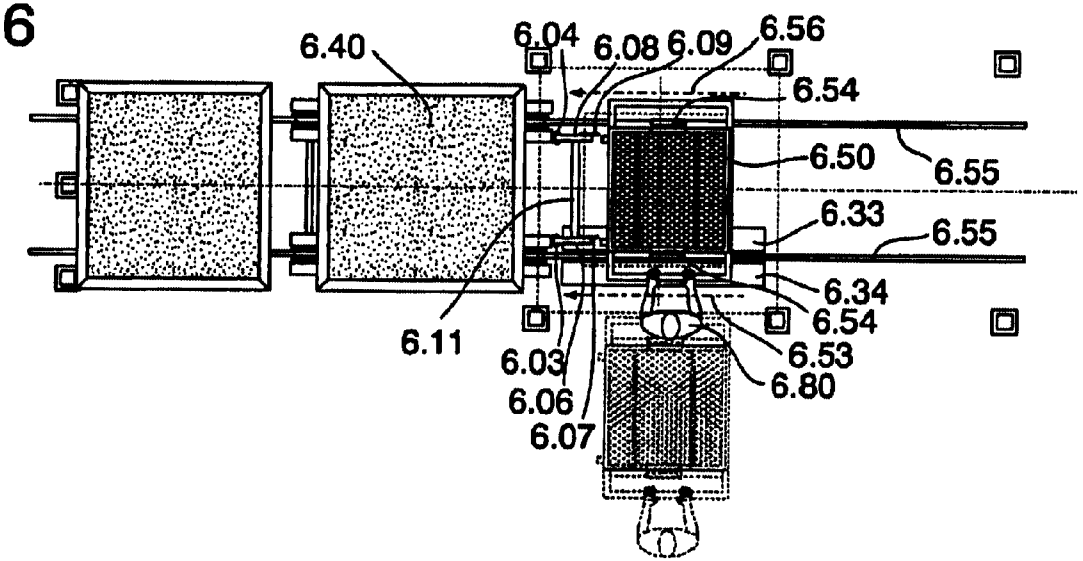

In FIG. 4 a drop cage retrieval hook 4.52 has been secured to a drop cage retrieval bar positioned between pairs of retrieval structures 4.54 and is shown vertically retrieving said drop furnace cage 4.50 into the internal portion of a drop furnace (not shown in FIG. 4) The vertical transitioning of the drop furnace cage 4.50 is in FIG. 4 indicated by lines 4.76. FIG. 4 also illustrates the proper positioning of the drop furnace cage apparatus having negotiated inclines 4.33 and 4.34. In FIG. 4 drop cage positioning bar appendage receptacles 4.22 and 4.25 have accommodated positioning bar appendages (not shown) attached to positioning bars 4.06 and 4.08. Also shown in FIG. 4 are connecting structures 4.03 and 4.04 fixedly attached to quench tank 4.40 and to which said positioning bars 4.06 and 4.08 have been pivotally attached. FIGS. 5 and 6 further illustrates the method by which the practice of the instant invention may be effectuated in its preferred embodiment. Turning now to FIGS. 5 and 6.

As can be seen in FIGS. 5 and 6, a drop furnace cage 5.50 is first maneuvered along a first plane of travel as indicated by line 5.60 to cause said drop cage to be generally positioned under a drop furnace (not shown). In FIG. 6 the drop cage 6.50 is then maneuvered along a second plane of travel designated by line 6.53 to cause said drop cage to be aligned with the positioning bar appendages of the instant invention 6.07 and 6.09 thereby effectuating precise pre-retrieval positioning of said drop cage.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

I claim:

1. An apparatus used in combination with a drop furnace cage, drop furnace quench tank and drop furnace to connect a drop furnace cage to a drop furnace and accurately position the drop furnace cage for vertical retrieval into the internal portion of the drop furnace comprising:

a first connecting structure attached to a fixed position drop furnace component;

a first positioning bar receptacle attached to said drop furnace cage;

a first positioning bar attached to said first connecting structure and aligned to permit insertion of an appendage attached to one end of said first positioning bar within said first positioning bar receptacle;

a second connecting structure attached to a fixed position drop furnace component;

a second positioning bar receptacle attached to said drop furnace cage;

a second positioning bar attached to said second connecting structure and aligned to permit insertion of an appendage attached to one end of said second positioning bar within said second positioning bar receptacle;

an interconnecting member angularly attached to, and positioned between, said first and second positioning bars; and at least two pairs of drop cage retrieval structures attached to said drop furnace cage allowing the traversing therebetween of at least one drop cage retrieval hook.

2. The apparatus of claim 1 wherein said first and second positioning bars are each pivotally attached to said first and second connecting structures.

3. The apparatus of claim 1 wherein either of said first and second positioning bars is pivotally attached to said first or second connecting structures.

4. The apparatus of claim 1 further comprising a retrieval bar connecting each pair of retrieval structures.

5. An apparatus used in combination with a drop furnace cage, drop furnace quench tank and drop furnace to connect a drop furnace cage to a drop furnace and accurately position the drop furnace cage for vertical retrieval into the internal portion of the drop furnace comprising:

at least two drop cage retrieval structures attached to said drop furnace cage;

a first connecting structure attached to a drop furnace quench tank;

a first positioning bar receptacle attached to a drop furnace cage; and a first positioning bar attached to said first connecting structure and aligned to permit insertion of an appendage attached to one end of said first positioning bar within said first positioning bar receptacle.

6. The apparatus of claim 5 further comprising:

a second connecting structure attached to a drop furnace quench tank;

a second positioning bar receptacle attached to said cage;

a second positioning bar attached to said second connecting structure and aligned to permit insertion of an appendage attached to one end of said second positioning bar within said second receptacle; and an interconnecting support member angularly attached to, and between, said first and second positioning bars.

7. The apparatus of claim 5 wherein said first positioning bar is pivotally attached to said first connecting structure.

8. The apparatus of claim 5 or 6 wherein said first and second positioning bars are pivotally attached to said first and second connecting structures.

9. The apparatus of claim 5 further comprising a retrieval bar connecting each pair of retrieval structures.

* * * * *